US006241121B1

(12) United States Patent
Yasaka

(10) Patent No.: US 6,241,121 B1
(45) Date of Patent: Jun. 5, 2001

(54) COMMODITY ACCOMMODATING UNIT OF AN AUTOMATIC VENDING MACHINE

(75) Inventor: Yoshio Yasaka, Gunma (JP)

(73) Assignee: Sanyo Electric Co., LTD, Osaka (JP)

( * ) Notice: Subject to any disclaimer, the term of this patent is extended or adjusted under 35 U.S.C. 154(b) by 0 days.

(21) Appl. No.: 09/403,321

(22) PCT Filed: Mar. 31, 1998

(86) PCT No.: PCT/JP98/01457

§ 371 Date: Oct. 15, 1999

§ 102(e) Date: Oct. 15, 1999

(87) PCT Pub. No.: WO99/50804

PCT Pub. Date: Oct. 7, 1999

(51) Int. Cl.[7] ..... B65H 1/08
(52) U.S. Cl. ..... 221/226; 221/279
(58) Field of Search ..... 221/7, 9, 10, 17, 221/155, 191, 226, 227, 232, 268, 279

(56) References Cited

U.S. PATENT DOCUMENTS 4,667,803 5/1987 Gordon ..... 194/248

FOREIGN PATENT DOCUMENTS 2180527 4/1987 (GB) .

8-87672 4/1996 (JP) .

*Primary Examiner*—Kenneth W. Noland
(74) *Attorney, Agent, or Firm*—Darby & Darby

(57) ABSTRACT

There is provided an article storage device for an automatic vending machine, which is capable of properly storing and dispensing articles without causing any deformation or breakage thereof and, compact in construction, and at the same time capable of reliably detecting whether articles are sold out. The article storage device 1 for an automatic vending machine includes an article rack 10 received within a body 3 of the automatic vending machine and having an article passage 11 for storing a large number of articles S placed one behind another in a horizontal row in a front-rear direction, a stopper 12 arranged at a front end of the article passage 11 in a manner movable between an engagement position in which the stopper 12 faces the article passage 11, for stopping the articles S, and a dispensing position in which the stopper 12 is withdrawn from the article passage 11 for dispensing the articles S, a pusher 15 inserted into the article passage 11 in a manner movable in the front-rear direction between an extreme forward position thereof and an extreme rearward position thereof, for pressing on the articles S, and a drive mechanism 20 connected to the pusher 15 and having helical tension springs 30, 30 for urging the pusher 15 forward.

8 Claims, 14 Drawing Sheets

COMMODITY ACCOMMODATING UNIT OF AN AUTOMATIC VENDING MACHINE

TECHNICAL FIELD

This invention relates to an article storage device for an automatic vending machine, such as one which allows vendible articles actually contained therein to be viewed from outside, and more particularly to an article storage device of this kind which stores a large number of articles in horizontal rows.

BACKGROUND ART

Conventionally, as an article storage device of this kind, one as shown in FIG. 14 is known. The article storage device 70 includes pushers 73 arranged respectively in two article passages 72 formed in an article rack 71. A large number of articles S are stored in the article passages 72 in a manner placed one behind another in a horizontal row in a front-rear direction each in an upright position, between each of the pushers 73 and a transparent stopper 74 arranged on a front side of the article rack 71. The pushers 73 are mounted to the article rack 71 such that each pusher 73 is movable in the front-rear direction, and urged by a spiral spring, not shown, arranged at a rear end of the article rack 71 to constantly press on the articles S from a rear side of the article rack 71. Each pusher 73 is connected to the spiral spring by way of a flat belt, not shown. The flat belt has one end thereof connected to the spiral spring, and extends such that it reaches a front end of the article rack 71 and then makes a U-turn to extend rearward to have the other end thereof connected to the pusher 73. During a vending operation for vending an article S, the stopper 74 is pivotally moved to open the article passage 72, whereby a foremost one of the articles S is pushed forward from the article passage 72 by the pressing load of the pusher 73 to dispense the same for vending.

At a predetermined position of each flat belt, there is formed a hole, not shown, while the article rack 71 has switches, neither of which is shown, each having a lever engageable with the hole. These switches and holes constitute part of a detecting device for detecting whether articles S are sold out. When all the articles in one of the article passages 72 are sold out and the corresponding pusher 73 has reached its extreme forward position, the lever is engaged with the hole of the flat belt to turn on the switch, thereby detecting that the articles S are sold out.

In the article storage device 70 constructed as above, the pressing load of the pusher 73 is basically sufficient if it has a magnitude required for smoothly moving all the articles S stored in the article passage 72. On the other hand, according to the conventional article storage device 70 described above, the spiral spring is used as means by which the pusher 73 obtains the urging force for pressing on the articles S. Spiral springs generally have a characteristic that the urging forces thereof are not largely changed with respect to a stroke thereof. Therefore, as shown by a dotted line in FIG. 13, even if the number of articles stored in the article passage 72 is decreased, the pressing load of the pusher 73 for pressing on the articles S is not sharply reduced.

As a result, even when the articles S received in the article passage 72 are considerably decreased in number, an excessively large pressing load which makes little difference from a pressing load applied when a lot of articles S are stored in the article passage 72 is applied to the articles S. Therefore, if containers for the articles S are made of soft materials, deformation or breakage thereof can be caused, resulting in spoiled commercial values of the articles. For the same reason, when the number of articles S stored in the article passage 72 is considerably decreased, the total frictional resistance of the articles S is decreased, and hence the moving speed of the articles S during a dispensing operation becomes very high. This causes an article S to be dispensed with a large force, thereby causing the above deformation or breakage or incapability of a normal execution of the vending operation. Further, since each spiral spring is arranged at the rear end of the article rack, the effective storage length of the article passage 72 is reduced by space in which the spiral spring is arranged.

Further, the detecting device for detecting whether the articles S are sold out is comprised of switches or the like provided separately from the article rack 71. Hence, a separate space exclusively provided for the detecting device is required. In addition, since the detecting device is configured such that the lever of each switch is engaged with a hole formed in a long flat belt, the lever can be hindered from being engaged with the hole in the flat belt due to inaccurate location of the hole or stretching of the flat belt caused by use thereof. In such a case, it is impossible to detect whether the articles S are sold out.

DISCLOSURE OF THE INVENTION

It is an object of the invention to provide an article storage device for an automatic vending machine, which is capable of properly storing and dispensing articles without causing any deformation or breakage of the articles, compact in construction, and at the same time capable of reliably detecting whether the articles are sold out.

To attain the above object, the present invention provides an article storage device for an automatic vending machine, comprising an article rack received within a body of the automatic vending machine and having an article passage for storing a large number of articles placed one behind another in a horizontal row in a front-rear direction, a stopper arranged at a front end of the article passage in a manner movable between an engagement position in which the stopper faces the article passage, for holding the articles, and a dispensing position in which the stopper is withdrawn from the article passage, for dispensing the articles, a pusher inserted into the article passage in a manner movable in the front-rear direction between an extreme forward position thereof and an extreme rearward position thereof, for pressing on the articles, and a drive mechanism connected to the pusher and having a helical tension spring for urging the pusher forward.

According to this article storage device for an automatic vending machine, in order to press on articles, the pusher is inserted into the article passage in a manner movable in a front-rear direction between its extreme forward position and its extreme rearward position. The pusher is urged forward by the helical tension spring of the drive mechanism. Therefore, when the stopper arranged at the front end of the article passage is moved to the dispensing position, articles stored in the article passage are pushed by the pusher and dispensed from the article passage. The helical tension spring urging the pusher has an urging force increasing or decreasing at a larger rate with respect to a stroke thereof than the spiral spring used in the conventional article storage device. Hence, when the number of articles in the article passage is decreased, the pressing load of the pusher becomes considerably reduced according to a decrease in the number of articles, whereby the pressing load of the pusher can be adjusted to a suitable magnitude in accordance with the number of articles stored. Therefore, even when containers for articles are made of soft materials, it is possible to prevent deformation or breakage of such containers, to preserve the commercial values. For the same reason, the speed of motion of articles during dispensing thereof is reduced, so that it is possible to prevent deformation or breakage of the articles and eliminate trouble in vending the same, thereby ensuring a smooth vending operation of the automatic vending machine.

Preferably, a plurality of the article racks are in vertical arrangement, each of the article racks being placed on a shelf provided within the body of the automatic vending machine, in a manner movable in the front-rear direction, the pusher being provided on the shelf on which one of the article racks immediately above a corresponding one of the article racks is placed, in a downwardly protruding manner.

According to this preferred embodiment, the shelf originally used for placing an article rack thereon can be exploited to provide thereon a pusher for urging articles on an article rack under the shelf. This makes it possible to mount a pusher compact in construction without increasing the number of component parts of the device. Further, the article racks are placed on shelves in a manner movably in the front-rear direction, and the pushers are arranged on these shelves. Therefore, when an article rack is drawn out from the body of the automatic vending machine, the pusher is stopped at its extreme forward position and does not obstruct an operation for loading the rack with articles. This makes it easy to carry out the loading operation.

Preferably, the drive mechanism is attached to the shelf.

According to this preferred embodiment, the shelf used for mounting the article rack is exploited for attaching the drive mechanism to the same. Therefore, it is possible to secure a longer effective storage length of the article passage than the conventional article storage device having a drive mechanism provided at a rear portion of an article rack thereof, and thereby increase the number of articles that can be stored in the article rack.

Preferably, the drive mechanism includes a speed reduction mechanism having a plurality of gears meshing with one another, one of the plurality of gears having the helical tension spring attached thereto in a manner urging the one of the plurality of gears.

According to this preferred embodiment, the drive mechanism includes a speed reduction mechanism, and one of a plurality of gears of the mechanism has a helical tension spring attached thereto. Hence, it is possible to secure a longer range of travel of the pusher with respect to a stroke of the helical tension spring through cooperation of the helical tension spring and the speed reduction mechanism. In addition, by changing the reduction ratio of the speed reduction mechanism and the modulus of elasticity of the helical tension spring, it is possible to obtain forces for urging the pusher such that they have various characteristics. Hence, the pressing load of the pusher can be set to a desired characteristic.

Preferably, the one of the gears has two the helical tension springs attached thereto in parallel with each other at respective locations symmetric with respect to an axis of rotation thereof, the two the helical tension springs having an identical spring constant.

According to this preferred embodiment, the urging force of the two helical tension springs acts on the one of the gears in a dynamically well-balanced manner, to transmit torque thereto. Therefore, the drive mechanism is smoothly operated for urging the pusher.

Preferably, the drive mechanism includes a sensor for detecting whether or not the pusher is at the extreme forward position.

According to this preferred embodiment, whether or not the pusher is at the extreme forward position can be detected by the sensor provided in the drive mechanism. Hence, by defining the extreme forward position as a position which the pusher assumes when the articles in an article passage are sold out, it is possible to detect whether the articles are sold out. This allows the drive mechanism to double as a sellout-detecting device, so that the article storage device can be made compact in construction without increasing the number of component parts thereof.

Preferably, the sensor is a switch operated by being pressed on, one of the plurality of gears having a projection formed at a predetermined location thereon, the projection pressing on the switch when the pusher is at the extreme forward position.

According to this preferred embodiment, the drive mechanism includes a plurality of gears and a switch. When the pusher is at its extreme forward position, a projection formed at a predetermined location on one of the plurality of gears presses on the switch to cause the same to operate, so that based on an output signal from the switch, it is possible to detect that the pusher is at its extreme forward position, i.e. that articles are sold out. As described above, it is possible to reliably detect whether the articles are sold out, by the simple construction of the gears and switch included in the drive mechanism.

BEST MODE OF CARRYING OUT THE INVENTION

Figure 1:
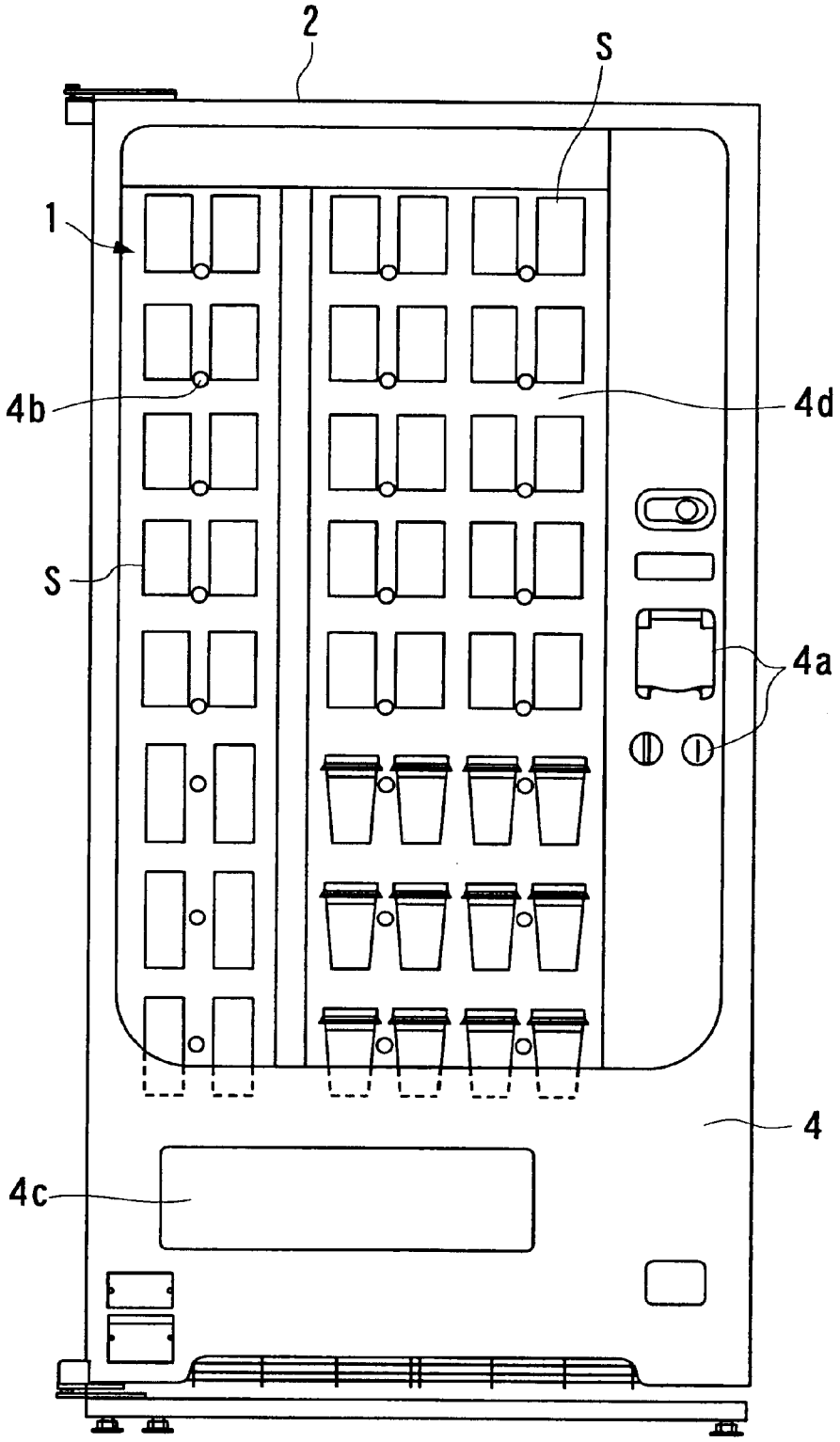
FIG. 1 is a front view of an automatic vending machine to which is applied an article storage device for an automatic vending machine according to an embodiment of the invention.
Figure 2:
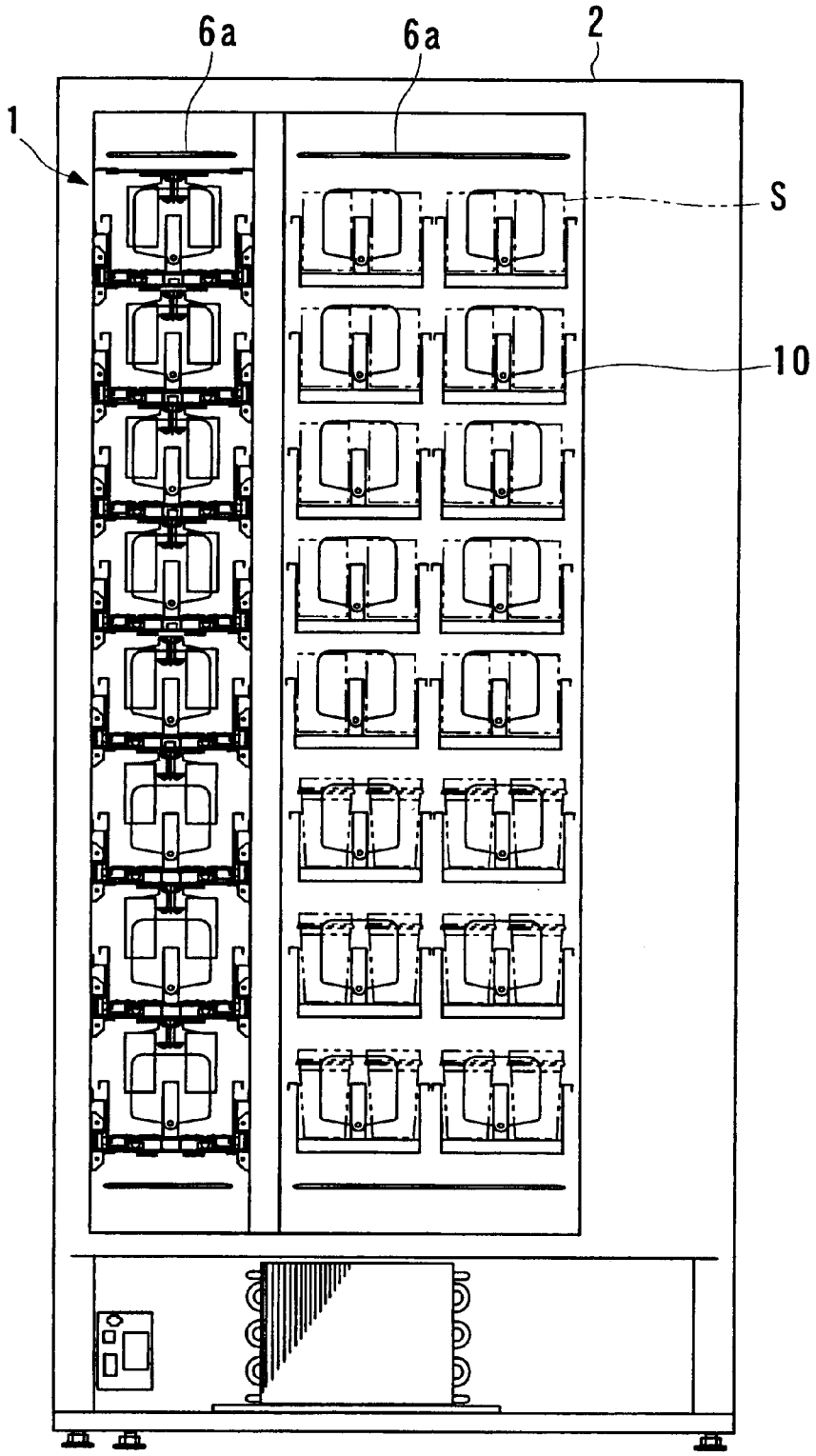
FIG. 2 is a front view of the automatic vending machine in a door-opened state.
Figure 3:
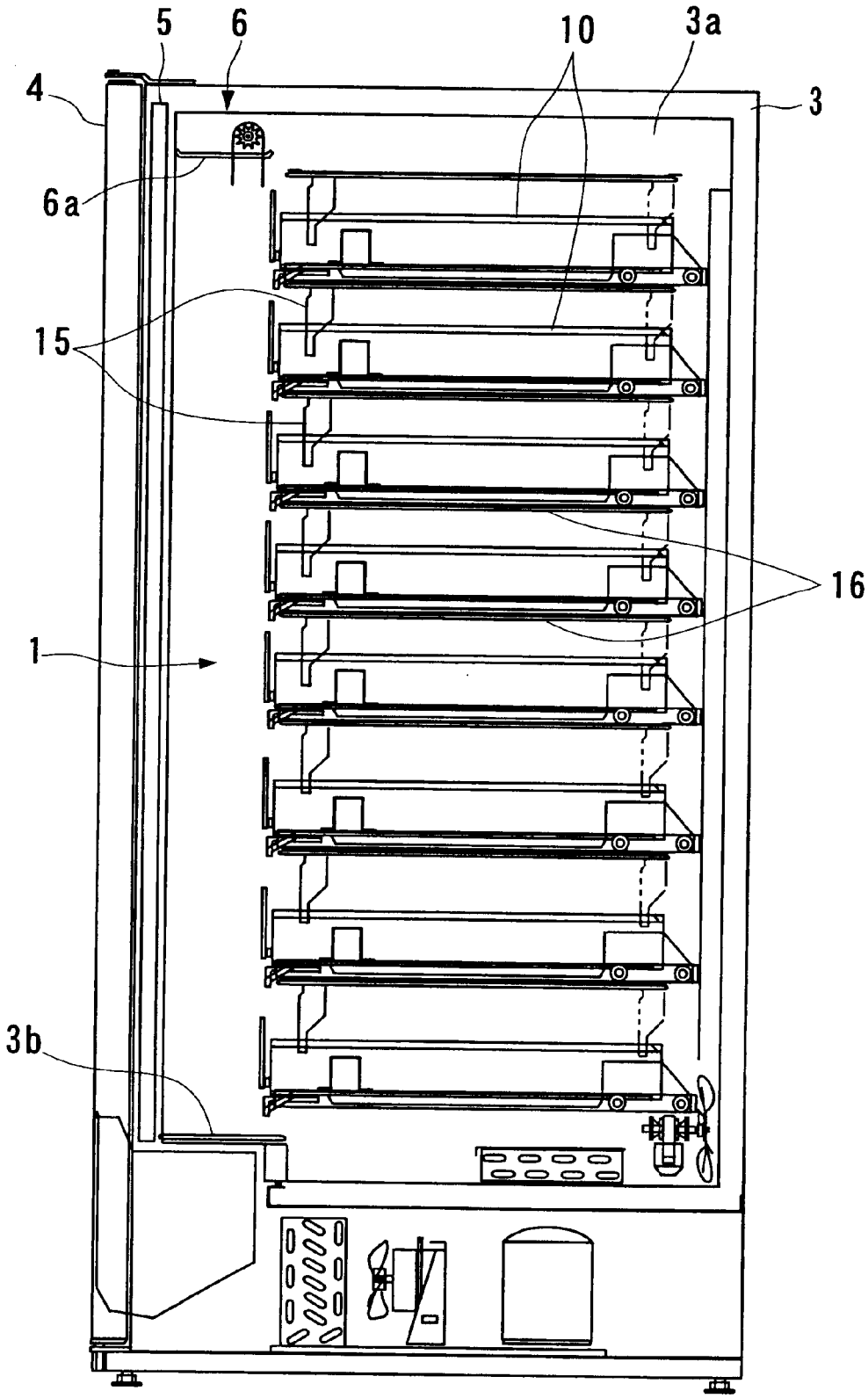
FIG. 3 is a sectional side elevation of the automatic vending machine.

An article storage device for an automatic vending machine according to an embodiment of the invention will be described below with reference to the accompanying drawings. As shown in FIGS. 1 to 3, this article storage device 1 is applied to a so-called see-through automatic vending machine 2 which allows vendible articles actually contained therein, such as canned juice or packed beverages, to be viewed from outside. The automatic vending machine 2 is comprised of a machine body 3, a main door 4 mounted on the front of the machine body 3, and a transparent heat insulating door 5 interposed between the main door 4 and the machine body 3.

On the front of the main door 4, there are arranged a plurality of money insertion slots 4*a*. When a user desires to buy an article, he can take out a desired article S from a product outlet 4*c* by putting money into one of the money insertion slots 4*a* and then pushing a selection button 4*b*. Further, the user can view each article S via a front window 4*d* forming an article display of the main door 4 and the transparent heat insulating door 5.

Figure 4:
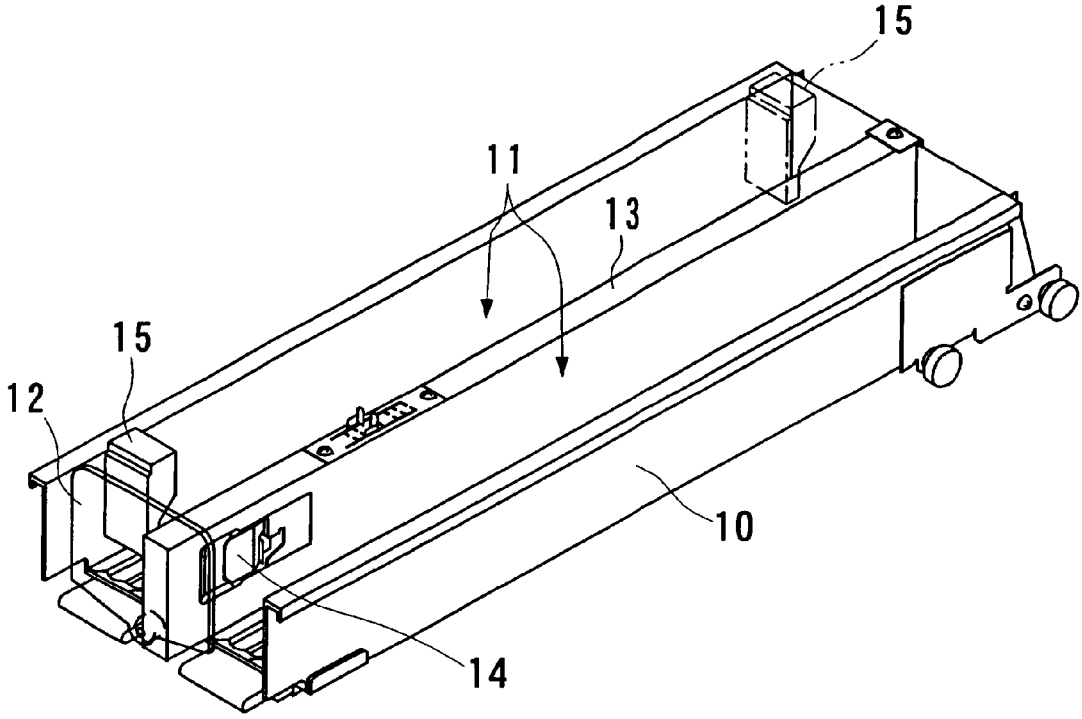
FIG. 4 is a perspective view of an appearance of construction of an article rack.
Figure 5:
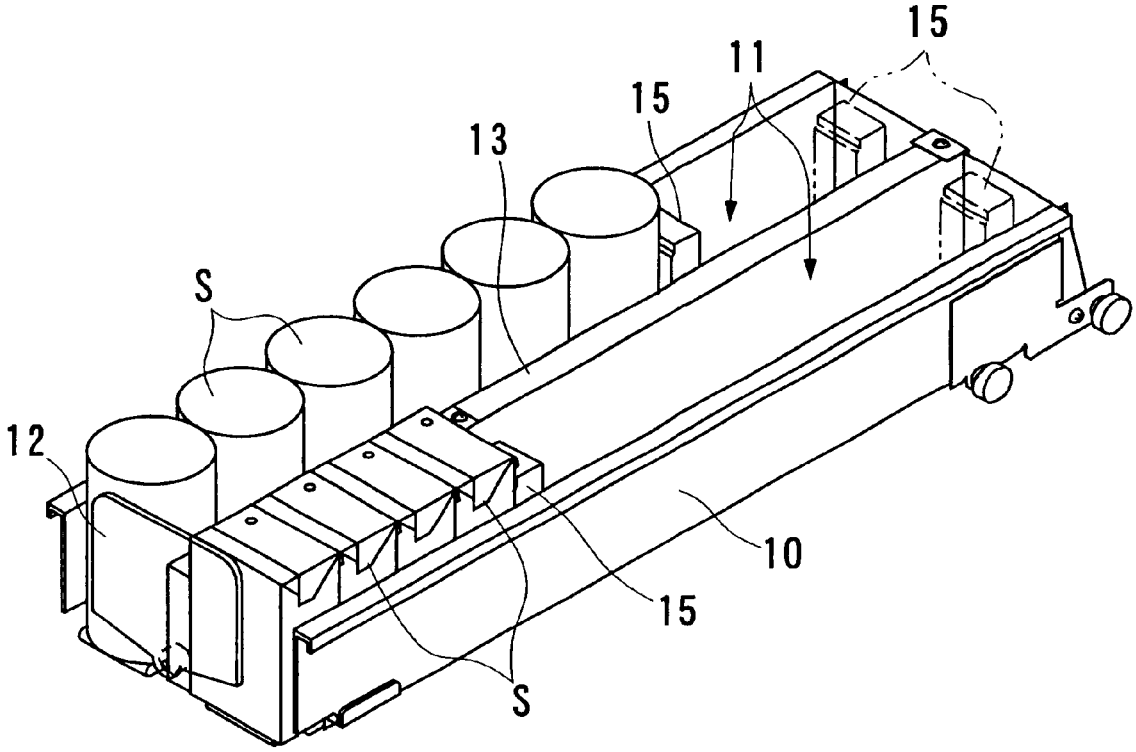
FIG. 5 is a perspective view of the article rack in a state storing articles therein.
Figure 6:
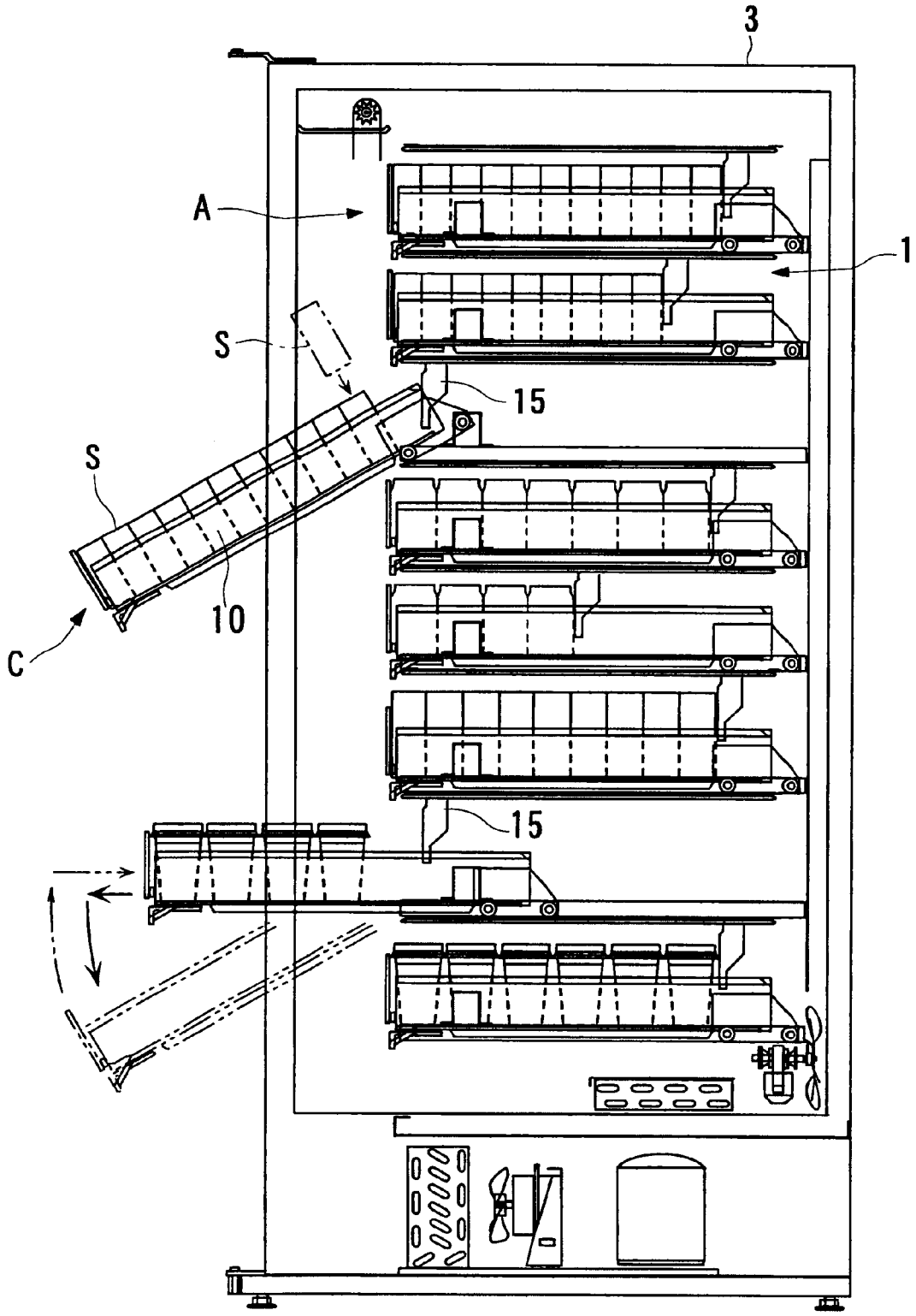
FIG. 6 is a diagram which is useful in explaining operations carried out when the article storage device is loaded with articles.

Further, as shown in FIGS. 2 and 3, mounted in a storage box 3*a* of the machine body 3 are article racks 10 which are arranged in one column on a left-hand side and two columns on a right-hand side, that is, three columns in all, with eight layers arranged one above another forming each column. Referring to FIG. 6, each article rack 10 is placed on a shelf 16 in a manner movable between a retracted position (position designated by symbol A in the figure) in which the rack is retracted to a predetermined location in the machine body 3 and a drawn-out position (position designated by symbol C in the figure) in which the rack has been drawn out forward e.g. for loading it with articles S. As shown in FIGS. 4 and 5, each of the article racks 10 is formed with two article passages 11. In each of the article passage 11, a large number of articles S of the same kind are placed one behind another in a horizontal row in a front-rear direction each in an upright position. The storage box 3*a* has two elevators 6 arranged in a space in front of the article racks 10 such that the elevators 6 can move up and down between the vicinity of the ceiling of the storage box 3*a* and a shutter 3*b* arranged on the bottom of the same. An article S dispensed from one of the article passages 11 is carried on a carrier plate 6*a* of a corresponding one of the elevators 6 down to the vicinity of the shutter 3*b*, and delivered via the shutter 3*b* to the product outlet 4*c* described above.

Further, as shown in FIGS. 4 and 5, each of the article racks 10 has a stopper 12 arranged at a front end thereof in a manner closing the fronts of the article passages 11, 11. The stopper 12 is formed of a board of a transparent synthetic resin (e.g. polycarbonate) and driven by a stopper drive mechanism, not shown, between an engagement position (position shown in FIG. 4) for engaging a sold article S of the articles S stored in each article passage 11 to stop the same, and a dispensing position, not shown, for dispensing the sold article S from the article passage 11 which is assumed through rotation from the engagement position to retract from the front of the article passage 11. During a vending operation, the stopper 12 is driven to move from the engagement position to the dispensing position. The article rack 10 has a partition wall 13 having a front end thereof provided with two blocking boards 14 (only one of them is shown in FIG. 4) facing the respective article passages 11. During a vending operation, the blocking board 14 is also pivoted by the stopper drive mechanism to project into the article passage 11 to hold a second article S (positioned next to the foremost one) between the partition wall 13 and the opposed side plate of the article rack 10.

Figure 7:
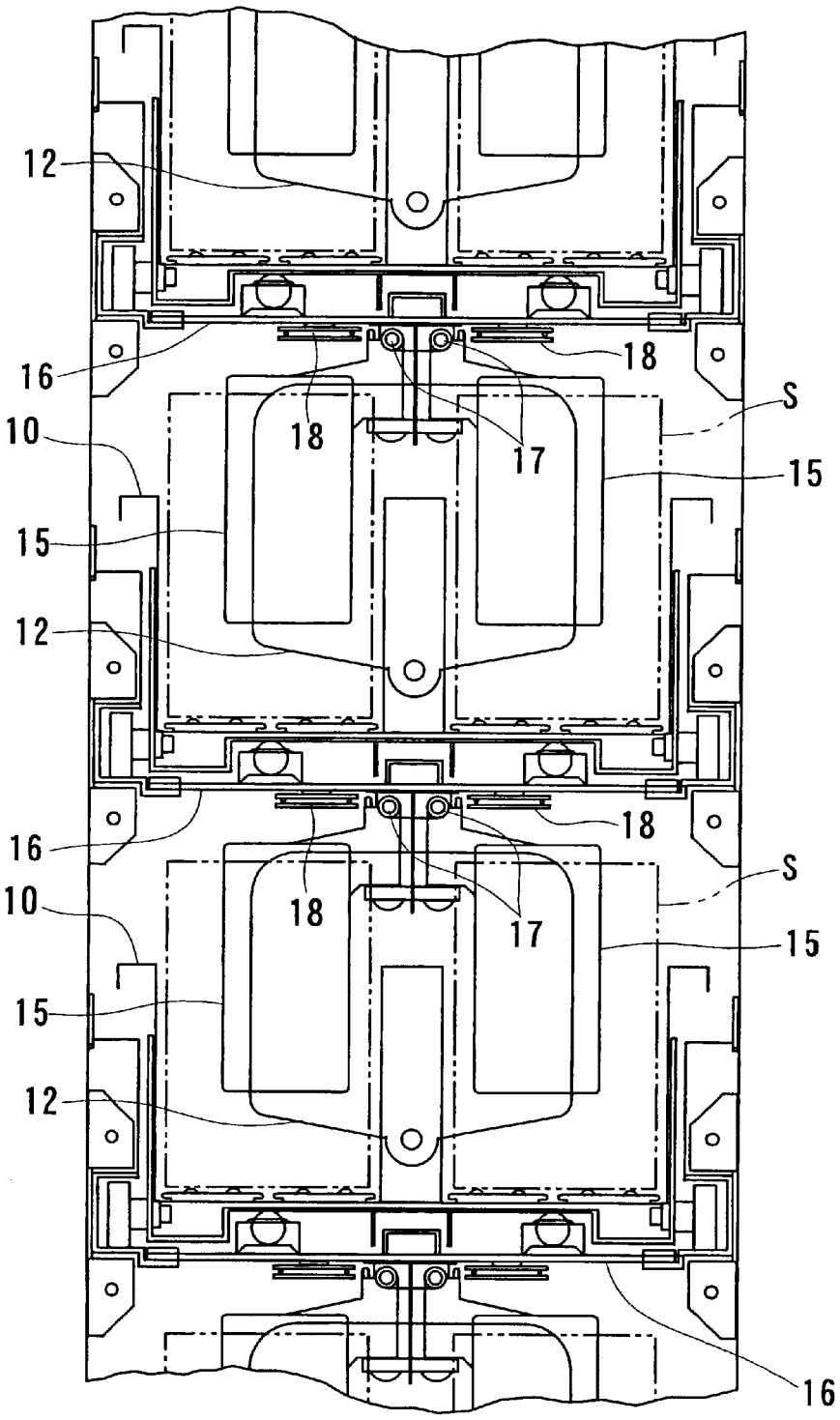
FIG. 7 is an enlarged partial view of essential elements of the FIG. 2 automatic vending machine.

Referring to FIGS. 3 and 7, each shelf 16 has a pair of left and right pushers 15, 15 projecting downward therefrom and a pair of left and right guide rails 17, 17 mounted along an underside surface thereof. Each of the pushers 15 is formed of a synthetic resin (e.g. polypropylene) and inserted into a corresponding one of the article passages 11 thereunder for abutting on an article S. Further, the pusher 15 is arranged in a manner such that the same can be moved along the guide rail 17 in the front-rear direction from its extreme rearward position (position of the pusher 15 shown by phantom lines in FIGS. 3 and 10) to its extreme forward position (position of the pusher 15 shown by solid lines in the same figures). The extreme forward position is defined by the pusher 15 being engaged with an engaging block 17*a* (see FIG. 9) arranged at a front end of the guide rail 17.

Figure 8:
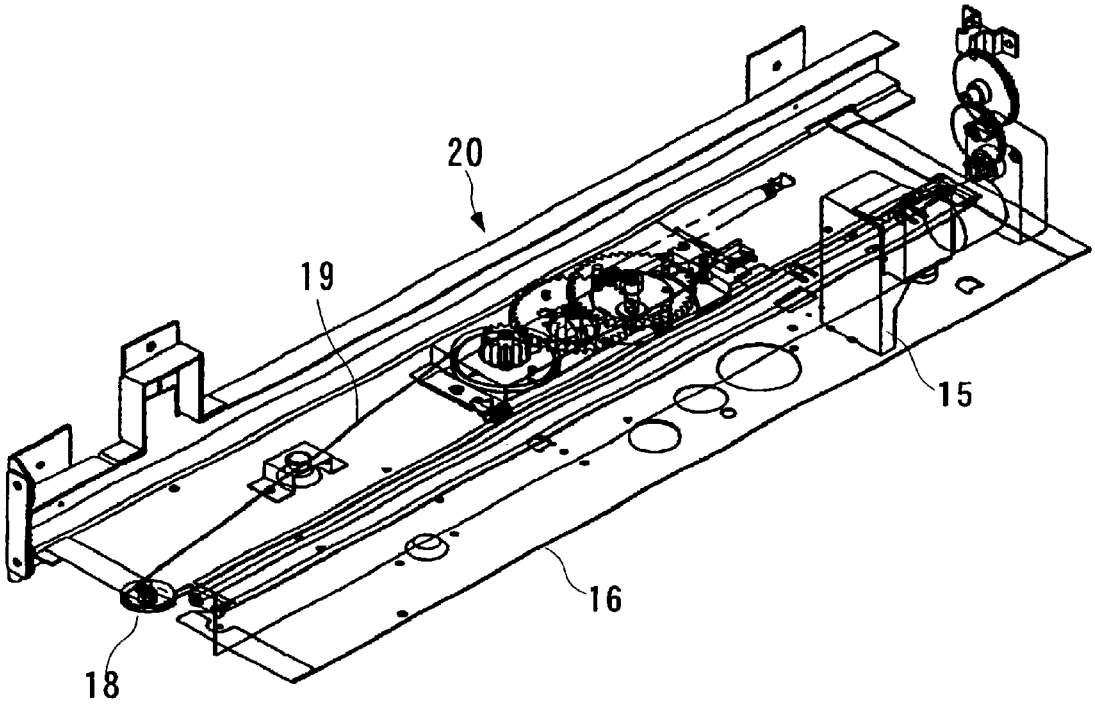
FIG. 8 is a perspective view of one of two drive mechanisms arranged on a shelf.
Figure 9:
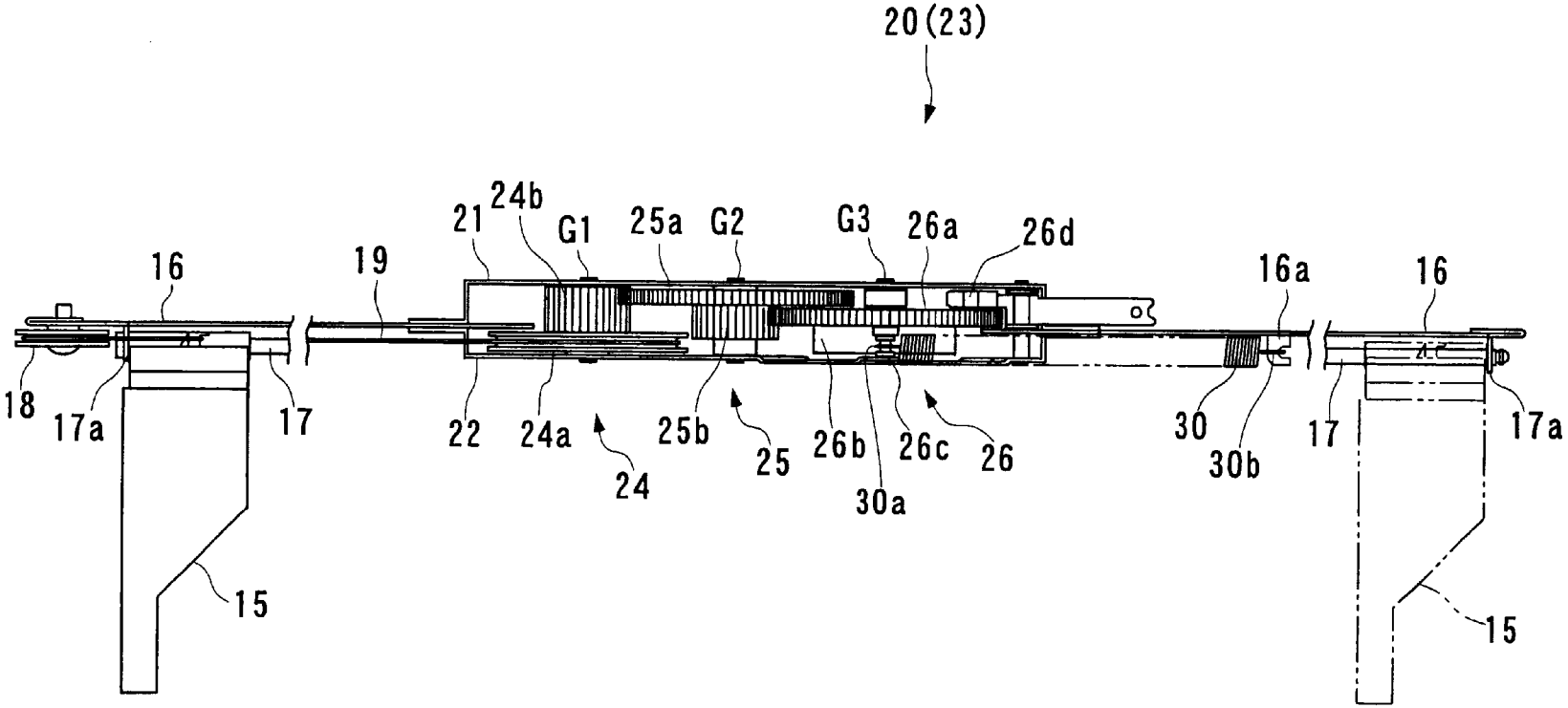
FIG. 9 is a side view showing the construction of the drive mechanism.
Figure 11:
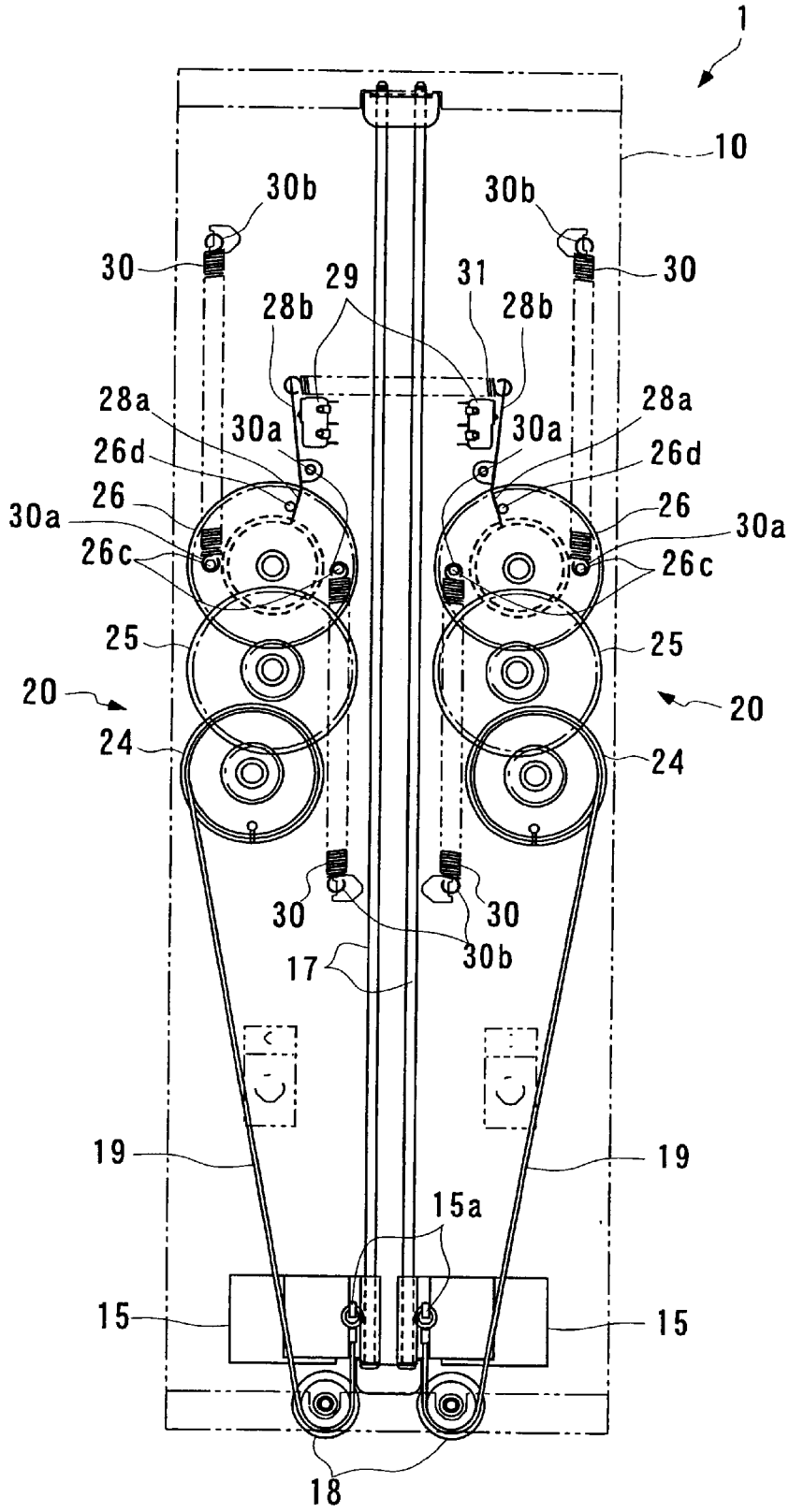
FIG. 11 is a plan view of helical tension springs and sellout-detecting switches, which is useful in explaining the operation thereof when a stopper is located at its extreme forward position.

A drive mechanism 20 is provided for each pusher 15, for constantly urging the above pusher 15 forward to thereby constantly press on the articles S toward the stopper 12 (see FIG. 11). As shown in FIGS. 8 and 9, the drive mechanism 20 is received between an upper case plate 21 and a lower case plate 22 which protrude from the respective top and underside surfaces of the shelf 16. These case plates 21, 22 are each constructed to have a small protrusion dimension, i.e. a small thickness. The drive mechanism 20 is connected to the pusher 15 by a wire 19. The wire 19 extending from the drive mechanism 20 is passed over a small pulley 18 rotatably arranged on the underside surface of a front end of the shelf 16 to make a U-turn and then rigidly fixed to a hook 15*a* formed on the top of the pusher 15.

Figure 10:
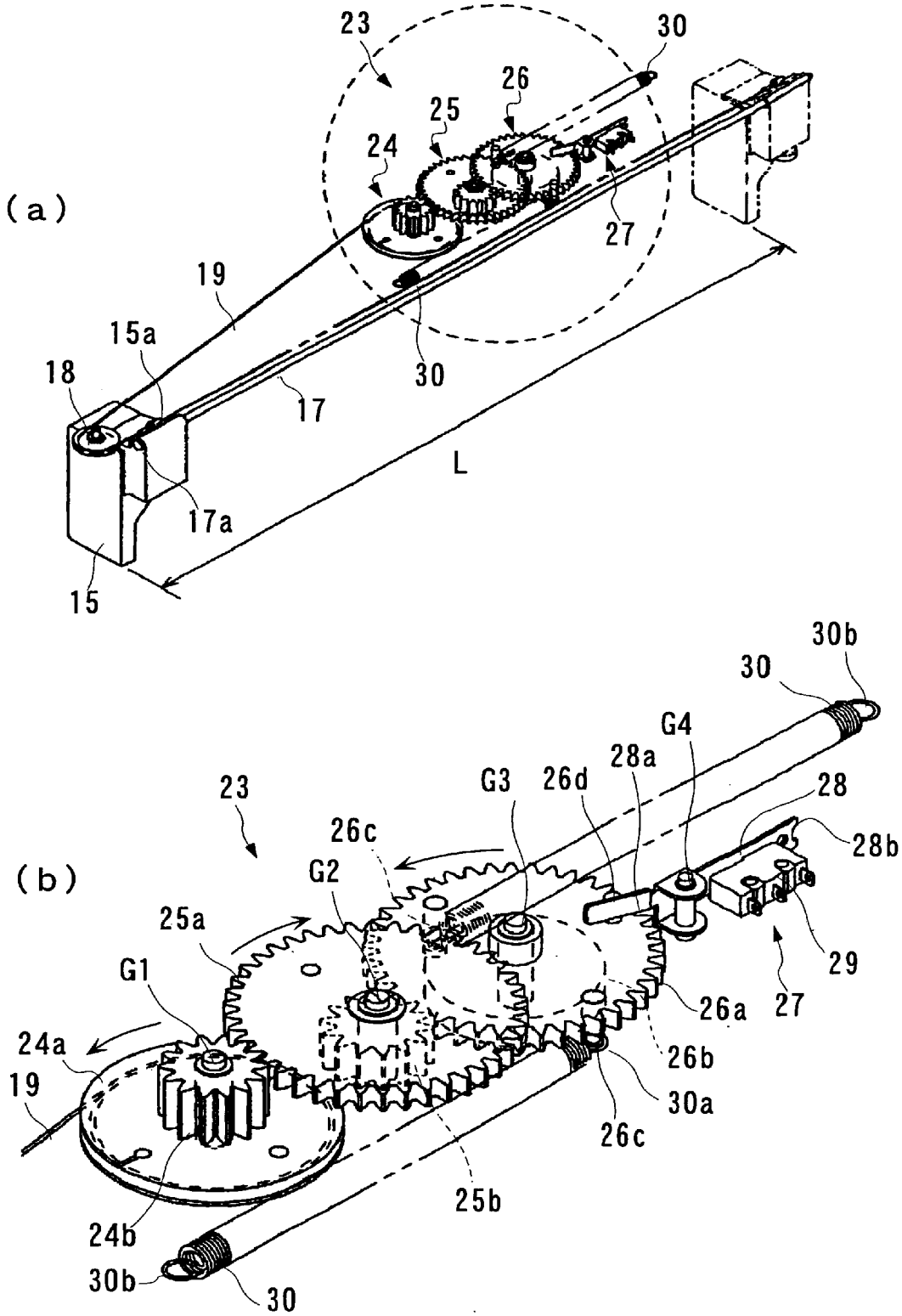
FIG. 10(*a*) is a perspective view showing the construction of the drive mechanism, and FIG. 10(*b*) is an enlarged partial perspective view of essential elements of the drive mechanism.

As shown in FIG. 10, the drive mechanism 20 includes a speed reduction mechanism 23 comprised of a pulley gear 24, an intermediate gear 25, and a drum gear 26, which mesh with one another. The pulley gear 24, intermediate gear 25 and drum gear 26 of the speed reduction mechanism 23 are rotatably supported on respective axles G1, G2 and G3 extending between the upper and lower case plates 21, 22. The pulley gear 24 is comprised of a pulley 24*a* over which the wire 19 is passed and a gear 24*b* formed integrally on the upper side of the pulley 24*a*. The intermediate gear 25 is comprised of a large gear 25*a* in mesh with the gear 24*b* and a small gear 25*b* integrally formed with the large gear 25*a*. The small gear 25*b* meshes with a gear 26*a* of the drum gear 26. A cylindrical drum 26*b* is formed integrally on the lower side of the gear 26*a*.

Figure 12:
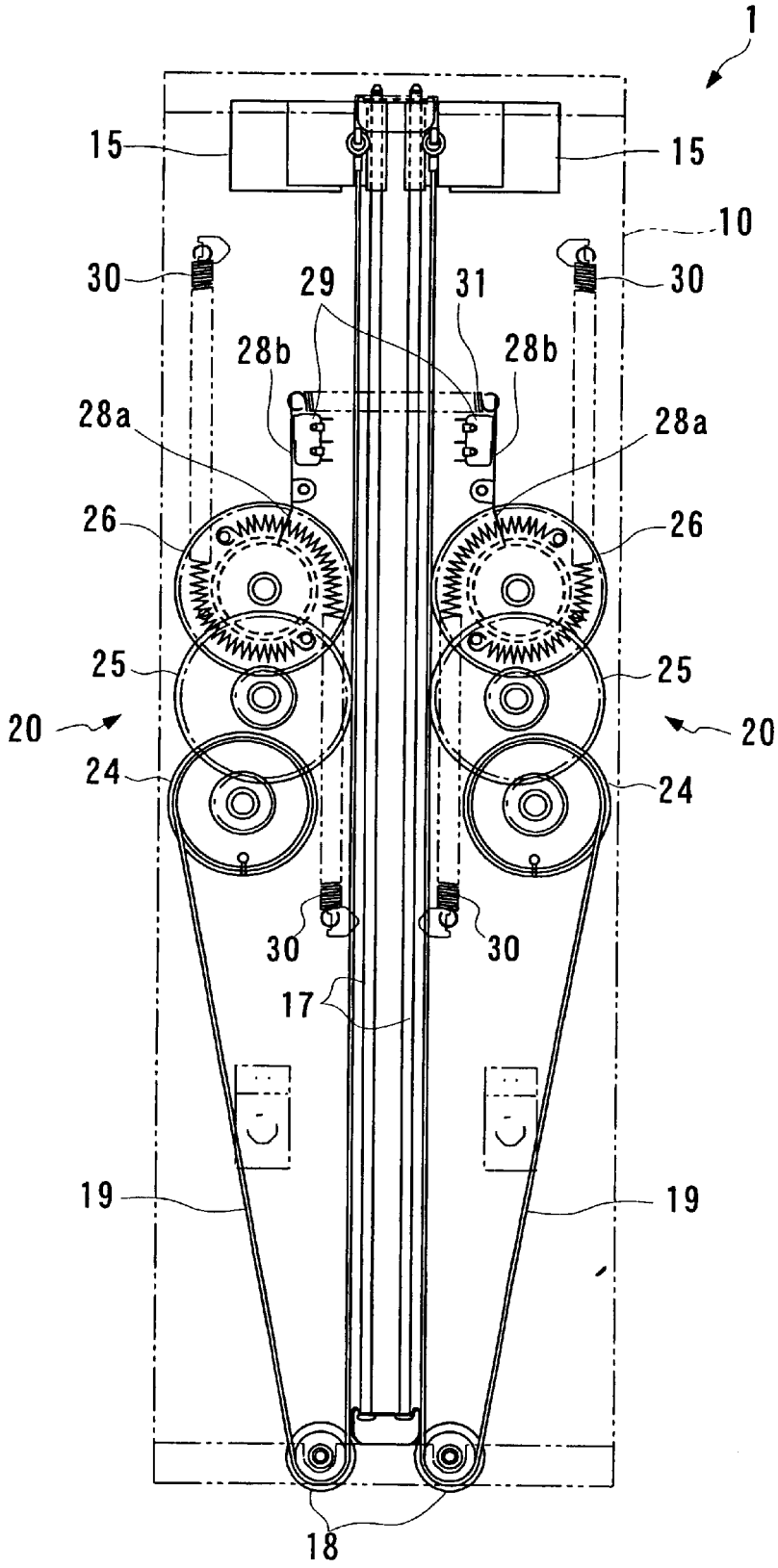
FIG. 12 is a plan view of the helical tension springs and sellout-detecting switches, which is useful in explaining the operation thereof when the stopper is located at its extreme rearward position.

On the underside of the gear 26*a* of the drum gear 26, there are provided two projections 26*c*, 26*c* at predetermined positions symmetric with respect to the axle G3. Further, under the gear 26*a* of the drum gear 26, there are arranged two helical tension springs 30, 30 having an identical spring constant, in parallel with each other. The helical tension springs 30, 30 have one end portions thereof formed with rings 30*a*, 30*a* which are engaged with the projections 26*c*, 26*c*, respectively. The other end portions of the helical tension springs are formed with rings 30*b*, 30*b* connected respectively to hooks 16*a*, 16*a* (only one of which is shown in FIG. 9) projecting downward from the underside of the shelf 16. Each helical tension spring 30 gives the pusher 15 a pressing load to be applied to the articles S. As shown in FIG. 12, as the pusher 15 is moved rearward, the helical tension spring 30 is wound around the surface of the drum 26*b* of the drum gear 26, and when the pusher 15 is positioned at its extreme rearward position, the maximum pressing load is imparted to the pusher 15. Further, as shown in FIG. 11, if the pusher 15 is positioned at its extreme forward position, the minimum pressing load is imparted to the pusher 15.

The drum gear 26 has a projection 26*d* extending upright from a predetermined location on the top surface of the gear 26*a* thereof, and a switch 27 as a sensor is arranged in the vicinity of the projection 26*d*. The switch 27 cooperates with the projection 26*d* to detect whether the articles S in the article passage 11 are sold out, and includes a switch arm 28 pivotally supported on the axle G4, and a switch body 29. The switch arm 28 has a short arm 28*a* and a long arm 28*b*. The short arm 28*a* is arranged at a location where the same is capable of abutting the projection 26*d*, while the long arm 28*b* is arranged such that the same can abut the switch body 29 to thereby cause the switch 27 to turn on. Further, as shown in FIG. 11, the long arm 28*b* has an end thereof engaged with a switch spring 31 which connects two long arms 28*b*, 28*b* provided for the left and right article passages 11, 11 and at the same time urges the long arms 28*b*, 28*b* toward each other.

In the drive mechanism 20, for instance, when an article rack 10 is retracted into the machine body 3 after loading the same with articles S, as shown in FIG. 10(*a*), each pusher 15 is pressed on by a rearmost one of the articles S received in the article passage 11, whereby the pusher 15 is moved along the guide rail 17 from its extreme forward position shown by solid lines in the figure to its extreme rearward position shown by phantom lines in the same figure. When the pusher 15 is thus moved, the wire 19 is pulled to thereby rotate the pulley gear 24 in a counterclockwise direction, as viewed in FIG. 10(*b*), and this torque is transmitted to the intermediate gear 25 via the gear 24*a* and the large gear 25*a* for clockwise rotation of the intermediate gear 25. Further, the torque of the intermediate gear 25 is transmitted to the drum gear 26 via the small gear 25*b* and the gear 26*b* to rotate the drum gear 26 in the counterclockwise direction. As the drum gear 26 rotates, the helical tension springs 30 are each extended while being wound around the drum 26*b* of the drum gear 26, whereby the pusher 15 is urged forward via the speed reduction mechanism 23 and the wire 19. In this state, since the two helical tension springs 30, 30 having an identical spring constant are connected to predetermined point-symmetrical locations on the gear 26*a* of the drum gear 26 in parallel with each other, as described hereinabove, the two helical tension springs 30 transmit torque to the drum gear 26 in a dynamically well-balanced manner to urge the pusher 15.

The speed reduction mechanism 23 is configured such that when the drum gear 26 rotates through a predetermined angle (e.g. 120 degrees) from a position shown in FIG. 11 to a position shown in FIG. 12, the pusher 15 is moved over a predetermined distance L (see FIG. 10(*a*)) from its extreme forward position to its extreme rearward position. In the article storage device 1, it is possible to secure a longer distance of travel of the pusher 15 with respect to a stroke of each of the helical tension springs 30 through the combination of the speed reduction mechanism 23 constructed as above and the helical tension springs 30.

Figure 13:
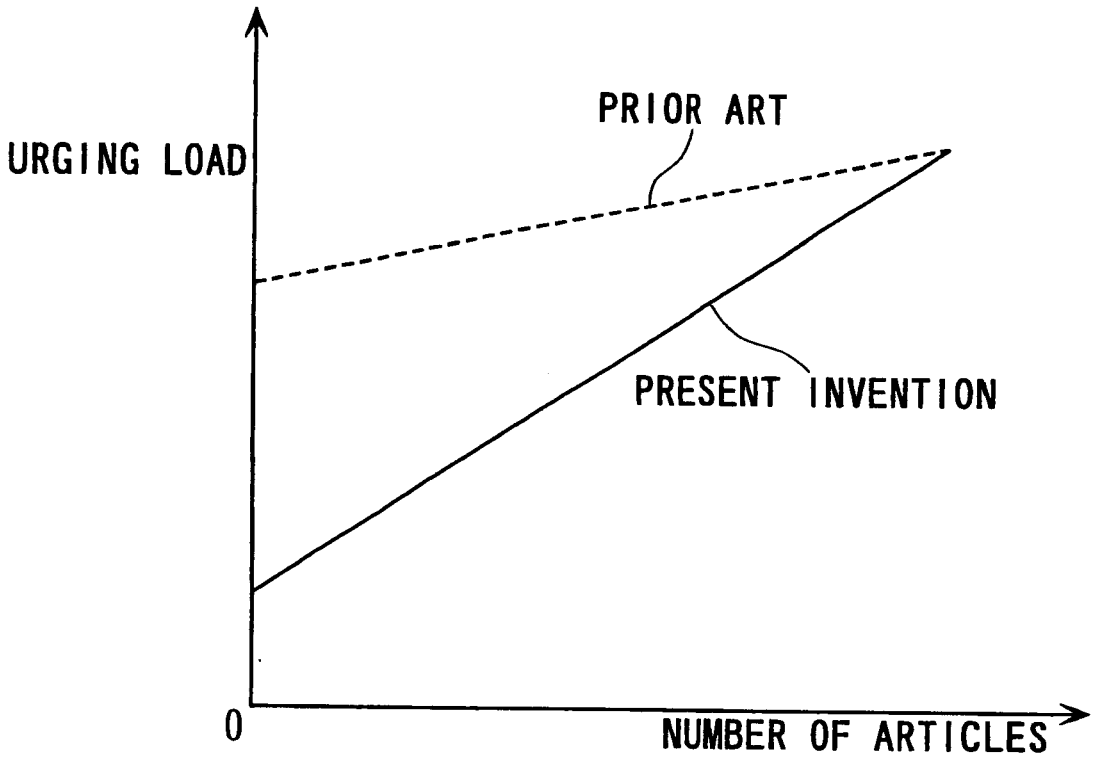
FIG. 13 is a graph useful in explaining the relationship between the number of articles and the pressing load of a pusher, for comparison between the present invention and a conventional article storage device.
Figure 14:
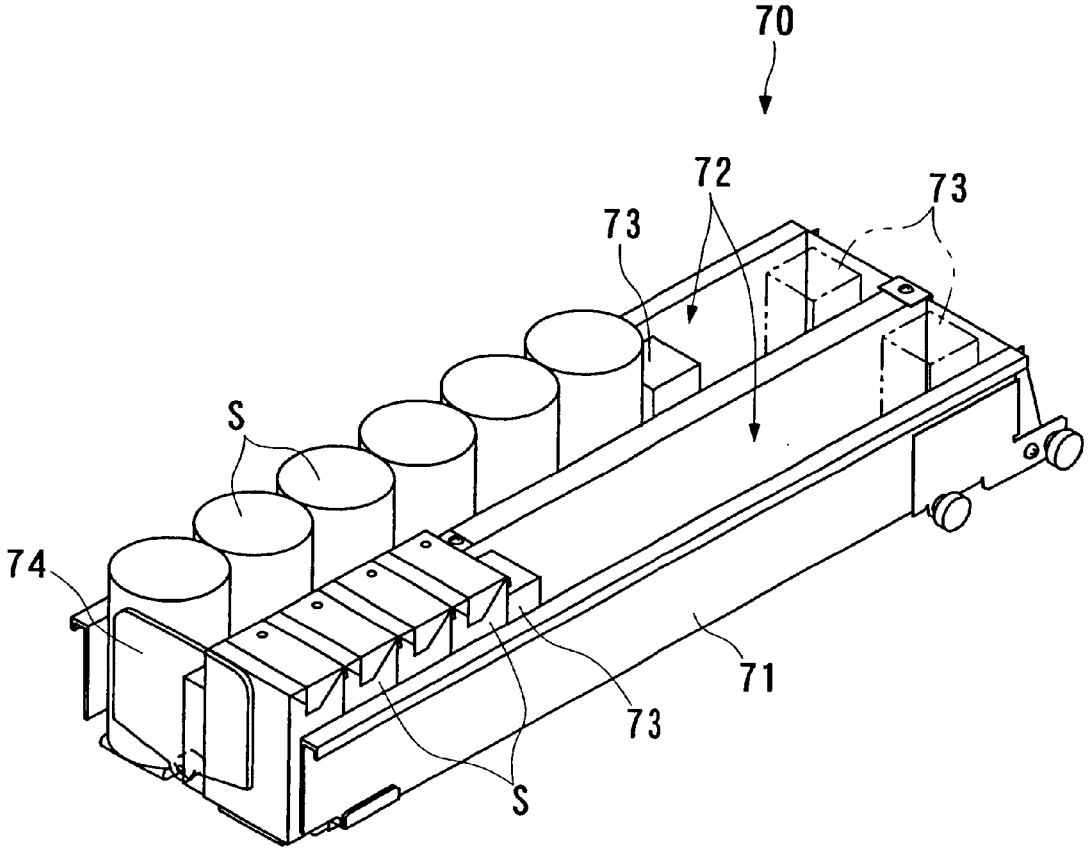
FIG. 14 is a perspective view of an article rack in the conventional article storage device for an automatic vending machine, in its state storing articles therein.

In the drive mechanism 20, the urging force of each helical tension spring 30 and the speed reduction mechanism 23 for urging the pusher, in other words, the pressing load of the pusher 15 for pressing on articles S forward is set such that it has a characteristic shown by solid lines in FIG. 13. More specifically, as shown in the figure, as the pusher 15 is moved forward with a decrease in the number of the articles S in the article passage 11, the pressing load of the pusher 15 is more sharply decreased than that of a conventional spiral spring shown by a dotted line in the figure. This prevents the articles S in the article passage 11 from being subjected to a larger pressing load than required, and hence the containers of the articles S are not deformed or broken even if they are made of soft materials.

Further, as shown in FIG. 12, when the pushers 15 are positioned at their extreme rearward positions, the switch arms 28, 28 are pulled by the urging forces of the switch spring 13 such that the long arms 28*b*, 28*b* approach each other. In this state, each of the long arms 28*b*, 28*b* is in abutment with the switch body 29 to place the switch 27 in an ON state. When the pusher 15 is moved from this position to its extreme forward position, the short arm 28*a* of the switch arm 28 abuts the projection 26*d* of the drum gear 26, as shown in FIG. 11, and the switch arms 28, 28 pivot such that the short arms 28*a*, 28*a* approach each other. This pivotal motion causes the long arm 28*b*, 28*b* to separate from the switch body 29 against the urging force of the switch spring 13, whereby the switch 27 is turned off.

The article storage device 1 is constructed such that the pusher 15 is positioned at its extreme forward position when all the articles in the article passage 11 are sold out. This makes it possible to detect that the articles S in the article passage 11 are sold out, by constantly monitoring a signal from the switch 27 to detect that the switch 27 has turned off.

The operation of the article storage device 1 constructed as above according to the present embodiment will be described. When the article storage device is on standby for vending, with the article rack 10 being in the retracted position in the machine body 3, and at the same time articles S being fully stored in the article passage 11, the pusher 15 is positioned at its extreme rearward position, as shown in FIG. 12. In this state, each helical tension spring 30 is in a most extended state, so that the pressing load applied to the articles S by the pusher 15 is maximum. Further, since the long arm 28*b* is pulled by the urging force of the switch spring 31, the switch arm 28 of the switch 27 is held in a state abutting on the switch body 29, whereby the switch 27 is in an ON state.

From this state, when the stopper 12 is rotated toward the dispensing position during a vending operation of the automatic vending machine, the pusher 15 is moved while pressing on the articles S, whereby one of the articles S is dispensed from the article rack 10. At this time, the pusher 15 is moved forward with a decrease in the number of the articles S. When the pusher 15 is moved forward, the urging force of the helical tension spring 30 causes the wire 19 to be taken up by the pulley 24*a* and at the same time the drum gear 26 is rotated in a direction of contracting the helical tension spring 30. This contraction of the helical tension spring 30 reduces the pressing load of the pusher 15 (see FIG. 13). When all the articles S in the article passage 11 are sold out, the pusher 15 is moved to its extreme forward position shown in FIG. 11. At this time, since the helical tension spring 30 is in a most contracted state, the pressing load of the pusher 15 is minimum (see FIG. 13). As described above, the pressing load of the pusher 15 can be suitably reduced with a decrease in the number of the articles S, so that it is possible to prevent the articles S in the article passage 11 from being subjected to a larger pressing load than required. Hence, the containers of the articles S cannot be deformed or broken even if they are formed of soft materials.

The switch arm 28 of each switch 27 has the short arm 28*a* thereof brought into contact with the projection 26*d* of the drum gear 26 and pushed thereby through rotation of the drum gear 26. This causes the switch arm 28 to separate from the switch body 29 against the urging force of the switch spring 31 to a position where the switch arm 28 is inhibited from pressing on the switch body 29, whereby the switch 27 is turned off. Therefore, by detecting a turn-off operation of the switch 27, it is possible to detect that the articles S are sold out, and by causing a lamp or the like, not shown, to be flickered as required, it is possible to notify the operator of sellout of the articles S.

In response to the notification of the sellout of the articles S, the operator draws out the article rack 10 to the drawn-out position indicated by symbol C in FIG. 6, and loads the rack with articles S. After the loading of the articles, the article rack 10 is retracted to the retracted position in the machine body 3, indicated by symbol A in the figure. When the article rack 10 is drawn out, the pusher 15 is engaged with the engaging block 17*a* of the guide rail 17 to stop at its extreme forward position, and as the article rack 10 is retracted into the machine body 3, the pusher 15 is moved rearward by being pressed on by a rearmost one of the articles S received in the article rack 10. If the article rack is fully loaded with articles S, the pusher 15 is pushed back to its extreme rearward position, whereby the drive mechanism 20 has the helical tension spring 30 fully extended, as shown in FIG. 12. This makes the pressing load of the pusher 15 maximum. At the same time, the switch arm 28 is held in abutment with the switch body 29, and hence the switch 27 is turned on to stop flickering of the lamp or the like, not shown, and the sold-out condition of the articles S is cancelled.

As described above, according to the article storage device 1 of the present embodiment, there is provided the drive mechanism 20 which moves the pusher 15 in the front-rear direction between its extreme forward position and its extreme rearward position. This drive mechanism 20 makes it possible to secure a long range of travel of the pusher 15 by cooperation of the two helical tension springs 30 and the speed reduction mechanism 23 as well as cause the pressing load of the pusher 15 to have a desired characteristic. More specifically, the pressing load of the pusher 15 can be suitably reduced with a decrease in the number of the articles S in the article passage 11. Differently from the conventional article storage device, this prevents the articles S in the article passage 11 from being subjected to a larger pressing load than required, and hence the containers of the articles S cannot be deformed or broken even if they are made of soft materials. Moreover, an article S is gently dispensed during a vending operation, which prevents deformation or breakage of the article S as well as eliminates trouble in the vending operation, thereby ensuring a smooth vending operation of the automatic vending machine.

Further, when all the articles in the article passage 11 are sold out, the pusher 15 is moved to its extreme forward position and the projection 26*a* formed on the drum gear 26 of the speed reduction mechanism 23 presses on the short arm 28*a* of the switch arm 28, whereby the switch 27 is caused to turn off. By constantly monitoring the signal indicative of the switching operation of the switch 27, it is possible to detect that the articles S are sold out. Therefore, the component parts of the drive mechanism 20 also serve as component parts of a detecting device for detecting whether the articles S are sold out, so that differently from the conventional article storage device, it is possible to reliably detect whether the articles S are sold out, and at the same time make the detecting device compact in construction without increasing the number of component parts thereof. Furthermore, the drive mechanism 20 is arranged on the shelf 16 on which the article rack 10 is placed, and made compact in construction, as described above. This allows the article storage device 1 to be made compact in construction.

Although in the above embodiment, whether articles S are sold out is detected by detecting a turn-off operation of the switch 27, this is not limitative, but inversely, the article storage device 1 may be configured such that whether the articles S are sold out is detected by detecting a turn-on operation of the switch 27. Further, the device for the detection may be constructed by using any of various sensors, such as a photo sensor and the like, so long as the same can detect whether the articles S are sold out.

INDUSTRIAL APPLICABILITY

As described above, according to the article storage device of the invention, it is possible to properly store and dispense articles without causing any deformation or breakage thereof. Further, the device can be made compact in construction and is capable of reliably detecting whether articles are sold out.

What is claimed is:

1. An article storage device for an automatic vending machine, comprising:

an article rack received within a body of said vending machine and having an article passage for storing a large number of articles placed one behind another in a horizontal row in a front-rear direction;

a stopper arranged at a front end of said article passage in a manner movable between an engagement position in which said stopper faces said article passage, for stopping said articles, and a dispensing position in which said stopper is withdrawn from said article passage, for dispensing said articles;

a pusher inserted into said article passage in a manner movable in said front-rear direction between an extreme forward position thereof and an extreme rearward position thereof, for urging said articles; and a drive mechanism having a speed reduction mechanism having a plurality of gears meshing with one another, one of said plurality of gears being connected to said pusher, and a helical tension spring attached to one of said plurality of gears in a manner urging said pusher forward via said speed reduction mechanism.

2. An article storage device according to claim 1, wherein a plurality of said article racks are in vertical arrangement, each of said article racks being placed on a shelf provided within said body of said vending machine, in a manner movable in said front-rear direction, said pusher being provided on said shelf on which one of said article racks immediately above a corresponding one of said article racks is placed, in a downwardly protruding manner.

3. An article storage device according to claim 2, wherein said drive mechanism is attached to said shelf.

4. An article storage device according to claim 1, wherein said one of said gears has two said helical tension springs attached thereto in parallel with each other at respective positions symmetric with respect to an axis of rotation thereof, said two said helical tension springs having an identical spring constant.

5. An article storage device according to claim 4, wherein said drive mechanism includes a sensor for detecting whether or not said pusher is at said extreme forward position.

6. An article storage device according to claim 5, wherein said sensor is a switch activated by being pressed on, one of said plurality of gears having a projection formed at a predetermined position, said projection pressing on said switch when said pusher is positioned at said extreme forward position.

7. An article storage device for an automatic vending machine, comprising:

a plurality of article racks received within a body of said vending machine such that said article racks are placed on a plurality of shelves arranged in a vertical row, respectively, said articles racks each having an article passage for storing therein a large number of articles placed one behind another in a horizontal row in a front-rear direction;

a stopper arranged at a front end of each of article passages of said plurality of article racks in a manner movable between an engagement position in which said stopper faces a corresponding one of said article passages, for stopping said articles, and a dispensing position in which said stopper is withdrawn from said corresponding one of said article passages, for dispensing said articles;

a pusher arranged on each of said shelves on which one of said article racks immediately above a corresponding one of said article racks is placed, in a downwardly protruding manner to be inserted into an article passage of said corresponding one of said article racks in a manner movable in said front-rear direction between an extreme forward position thereof and an extreme rearward position thereof, for urging said articles; and a drive mechanism connected to said pusher, for driving said pusher forward.

8. An article storage device according to claim 7, wherein said each of said article racks is arranged such that said each of said article racks can be drawn out of said body of said vending machine.

* * * * *

UNITED STATES PATENT AND TRADEMARK OFFICE

CERTIFICATE OF CORRECTION

PATENT NO. : 6,241,121 B1
DATED : June 5, 2001
INVENTOR(S) : Yoshio Yasaka

It is certified that error appears in the above-identified patent and that said Letters Patent is hereby corrected as shown below:

Title page,
Item [54] Title, change "COMMODITY ACCOMMODATING UNIT OF AN AUTOMATIC VENDING MACHINE" to -- ARTICLE STORAGE DEVICE FOR AUTOMATIC VENDING MACHINE --.

Signed and Sealed this

Twenty-ninth Day of January, 2002

*Attest:*

*Attesting Officer*

JAMES E. ROGAN
*Director of the United States Patent and Trademark Office*